US006217075B1

(12) United States Patent
Tsai

(10) Patent No.: US 6,217,075 B1
(45) Date of Patent: Apr. 17, 2001

(54) COLLAPSIBLE CLIPBOARD

(76) Inventor: Ching Tsung Tsai, 364, Sec. 2, Mei Liao, Rd, Chu In Li, Ho Mei, Chang Hua (TW)

( * ) Notice: Subject to any disclaimer, the term of this patent is extended or adjusted under 35 U.S.C. 154(b) by 0 days.

(21) Appl. No.: 09/632,780

(22) Filed: Aug. 4, 2000

(51) Int. Cl.[7] ..... B42D 17/00
(52) U.S. Cl. ..... 281/45; 402/4; 248/452
(58) Field of Search ..... 281/15.1, 21.1, 281/28, 29, 42, 45, 51; 402/4; 248/444.1, 451, 452

(56) References Cited

U.S. PATENT DOCUMENTS 3,670,370 * 6/1972 Goodwin ..... 281/45 X
4,896,927 * 1/1990 Liu et al. ..... 281/42 X
5,116,012 * 5/1992 Offenhaner et al. ..... 281/45 X
5,180,133 * 1/1993 Chang ..... 248/452
5,413,382 * 5/1995 Corvell et al. ..... 281/42 X
5,732,925 * 3/1998 Shamoon ..... 248/452
5,823,500 * 10/1998 La Coste ..... 248/444

* cited by examiner

*Primary Examiner*—Willmon Fridie, Jr.
(74) *Attorney, Agent, or Firm*—Dougherty & Troxell

(57) ABSTRACT

A collapsible clipboard includes a bottom case, a cap board and an upper board formed respectively integral of plastic, and all of them are pivotally connected with each other, enabling the upper board and the cap board respectively liftable from the bottom case easily and quickly.

7 Claims, 7 Drawing Sheets

COLLAPSIBLE CLIPBOARD

BACKGROUND OF THE INVENTION

This invention relates to a collapsible clipboard, particularly to one simple to assemble and collapse.

Conventional clipboards are popular, and used by workers engaging in warehouse, goods delivery, etc., and often provided with a hollow space for keeping necessary data therein. A known conventional clipboard 10 shown in FIGS. 1 and 2 includes a bottom case 11 made of a thin metal plate pressed to have four side vertical walls, a board 12 closed on the bottom base 11, and a drawer 13. The bottom case 11 have an inner hollow space 111 for containing paper or data, plural pivot supporters 112 formed spaced apart on an upper edge of a front vertical wall and respectively having a pivot hole 113. The board 12 has plural pivot supporters 121 with a pivot 122 holes spaced apart to interpose alternately with the pivot supporters 112 of the bottom case 11 for an elongate pivot 15 to fit in all the pivot supporters 112 and 121 so as to combine pivotally the board 12 with the bottom case 11. Further, the board 12 has an elastic clip 16 fixed on a middle section of a front end for pinching paper on the surface 123 of the board 12. In addition, a drawer case 124 is riveted under the right front bottom of the board 12 for a drawer 13 to slide in and out of. Then a calculator 17 can be stored in the drawer 13 to be taken out and used when necessary. The bottom case 11 has an aperture 114 formed in a front portion of the right side wall to face the drawer case 124 and a horizontal engage slot 115 formed in the middle section of a rear wall. The board 12 has an engage elastic bent small plate 125 movably fixed with rivets on the middle section of a rear end to fit through the horizontal engage slot 115 when the board 12 is closed on the bottom base 11 to secure the board 12 on the bottom base 11.

The conventional clipboard 10 still has the following disadvantages, in spite of its usefulness.

(1) The board 12 and the bottom case 11 are pivotally connected with the elongate pivot 15 fitting in the pivot holes 113 and 122 of the pivot supporters 112 and 121, all of which are to be aligned before the elongate pivot 15 can fit in. Then it may take much time to finish connecting pivotally the board 12 and the bottom case 11, very troublesome. In addition, the board 12 and the bottom case 11 are made of thin metal plates bent and then riveted, resulting in a high cost.

(2) The drawer case 124 for the drawer is located under the board 12 and placed in the interior 111 of the bottom case 11, so the right side wall of the bottom case 11 has to be cut the aperture 114 for the drawer 13 to move in and out. So the dimension of the interior 111 is reduced so that the height of the bottom case has to be increased for containing papers for use.

SUMMARY OF THE INVENTION

The objective of the invention is to offer a collapsible clipboard made of plastic, having a bottom case and a cap board pivotally connected to the bottom case, and an upper board smaller than the cap board pivotally connected to the bottom case. Then the upper board has plural hooks fixed on a lower surface to hold a calculator to be taken off if it is to be used.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
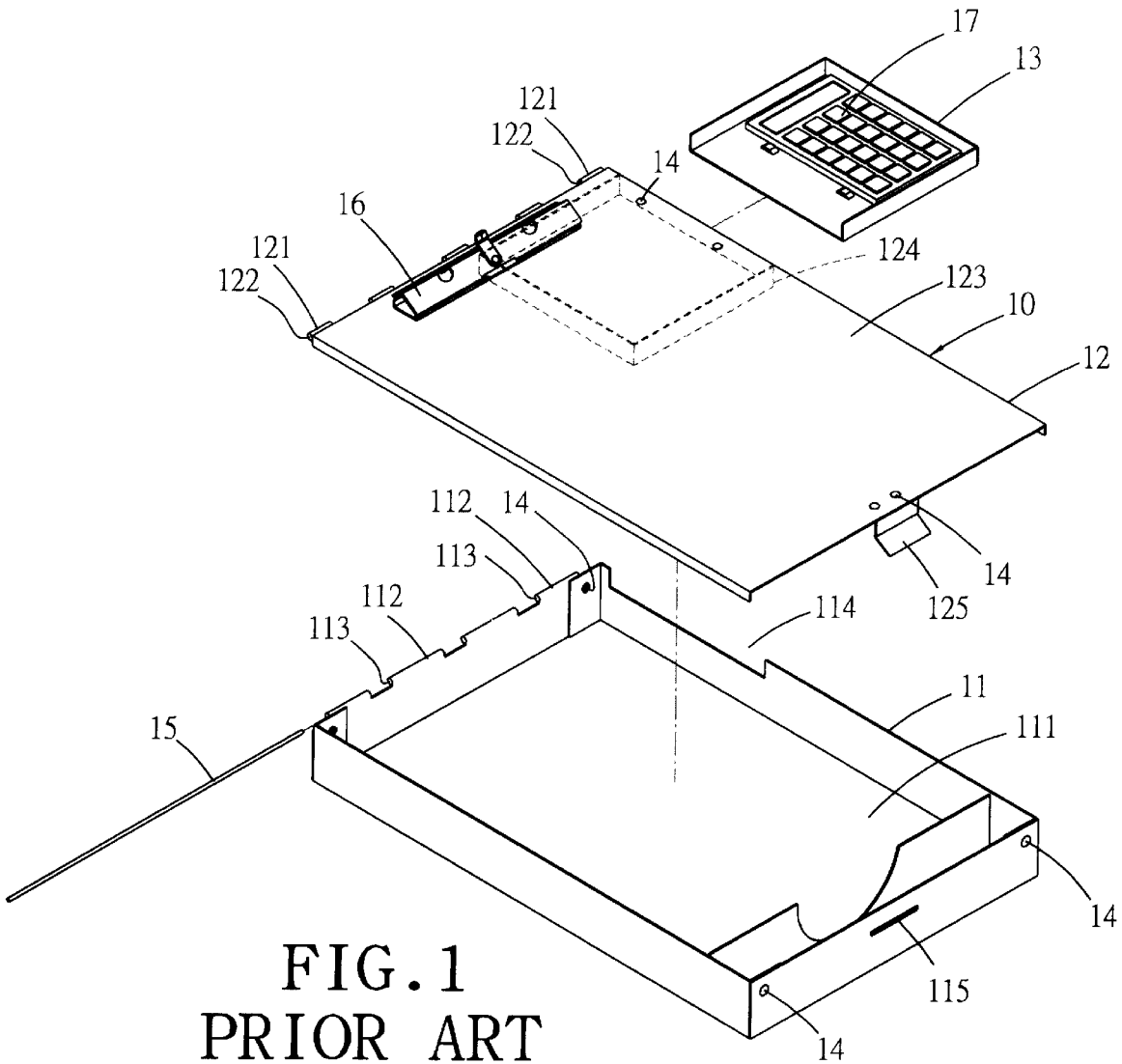
FIG. 1 PRIOR ART
FIG. 1 is an exploded perspective view of a known conventional clipboard.
Figure 2:
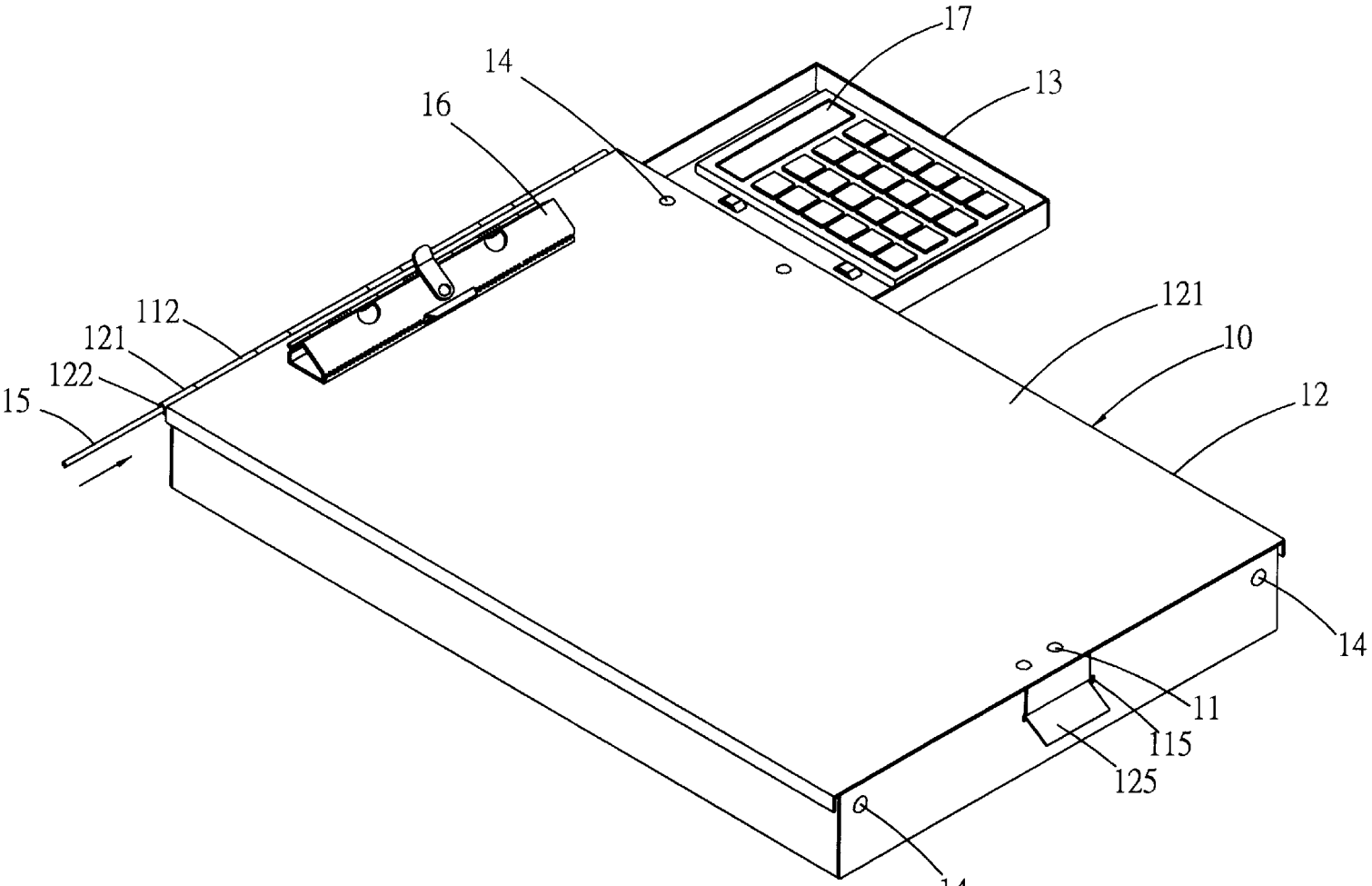
FIG. 2 PRIOR ART
FIG. 2 is a perspective view of the known conventional clipboard.
Figure 3:
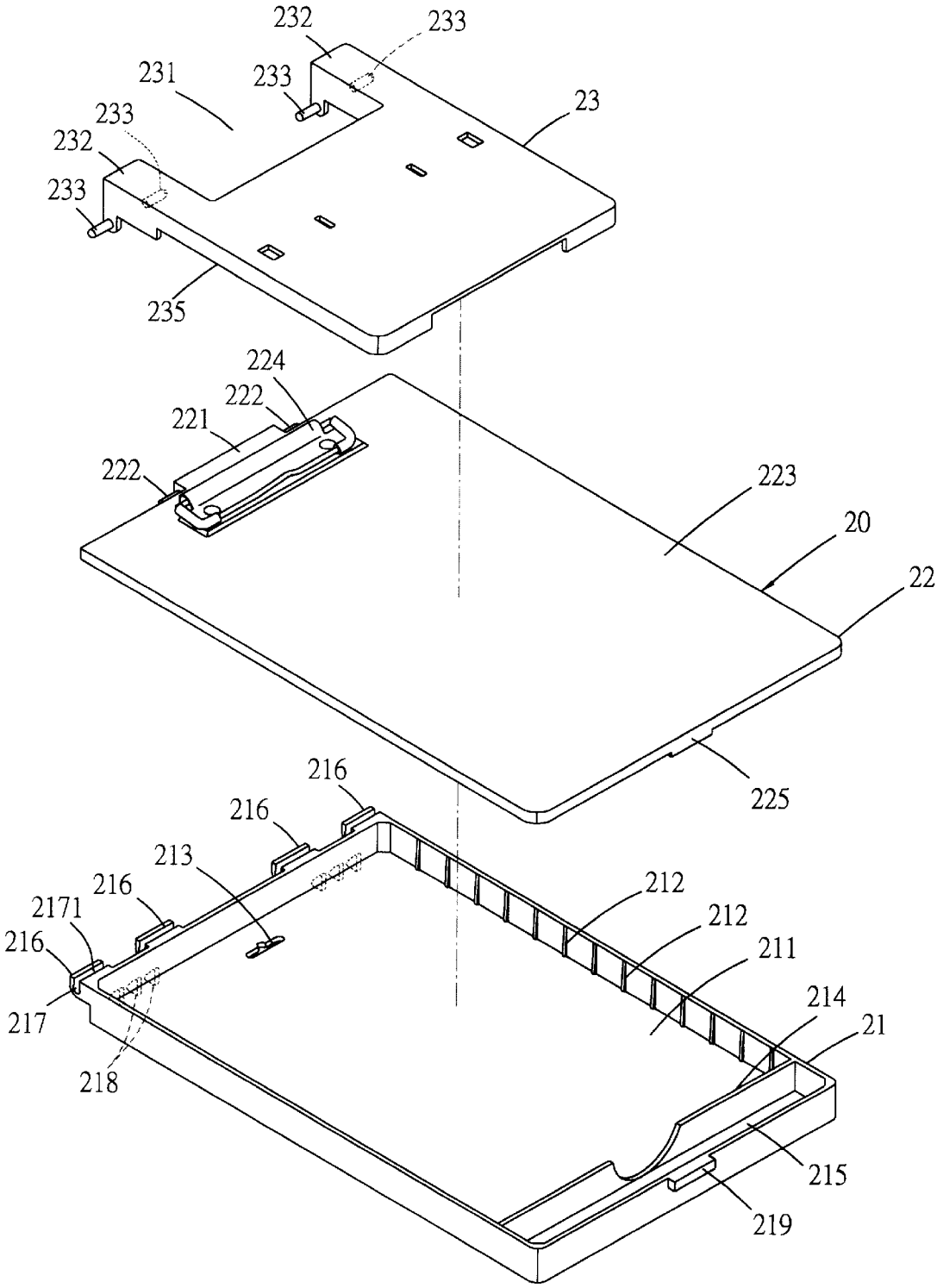
FIG. 3 is an exploded perspective view of a collapsible clipboard in the present invention.
Figure 4:
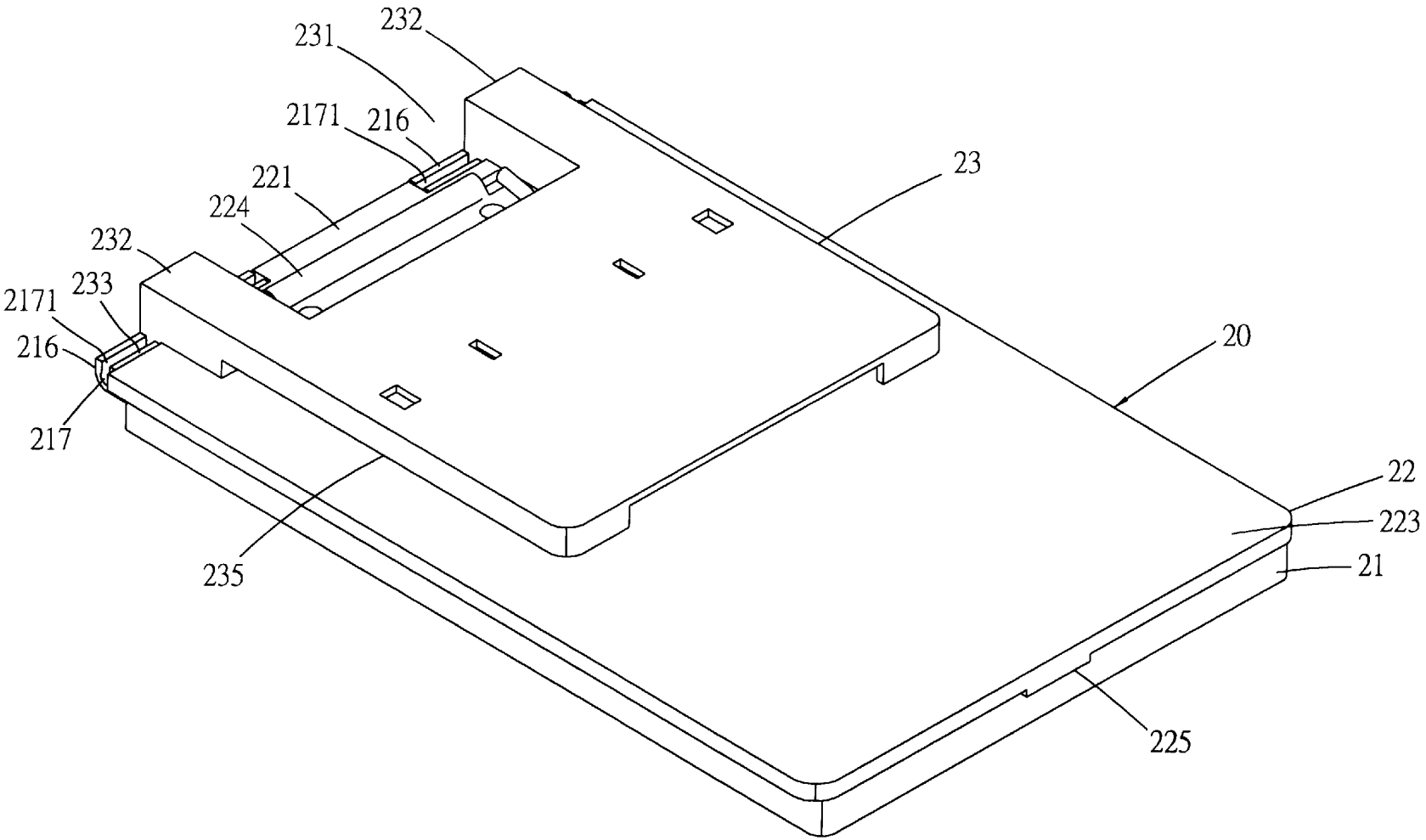
FIG. 4 is a perspective view of the collapsible clipboard in the present invention.

A preferred embodiment of a collapsible clipboard 20 in the present invention, as shown in FIGS. 3 and 4, includes a bottom case 21, a cap board 22, and an upper board 23 as main components The bottom case 21 is made of plastic, having a rectangular shape, an inner hollow interior 211, a plurality of tapered ribs 212 formed on an inner side of the two lengthwise sidewalls, a hook hole 213 formed in a middle section of a front portion of the bottom, a separate wall 214 parallel to and near the rear wall to define a small elongate room 215 for storing stationary. A plurality of pivot ears 216 respectively with a pivot groove 217 are provided spaced apart on an outer side of the front sidewall of the bottom case 21, and each pivot groove 217 has an upper opening 2171 of a little smaller width than the inner diameter of the pivot groove 217. Further, plural stop blocks 218 are fixed under the pivot ears 216 on the outer side of the front sidewall of the bottom case 21, and a small engage projection 219 is formed to protrude out on a middle section of the rear sidewall of the bottom case 21.

The cap board 22 is made of plastic, having the same shape and size as the bottom case 21 to close on the bottom case, having a pivot 221 formed on a middle section of a front side and a shaft 222 of a small diameter respectively formed to extend from two ends of the pivot 221. The shafts 221 fit in the pivot grooves 217 of the two inner pivot ears 216, enabling the cap board 22 to be lifted up with the shafts 222 as pivots from the bottom case 21. Further, an elastic clip 224 is fixed near the pivot 221 on the middle section of the front-end portion of the surface 223 of the cap board 22.for pinching paper, and an engage projection 225 is formed on a middle section of the rear end to engage the projection 219 of the bottom case 21.

Figure 5:
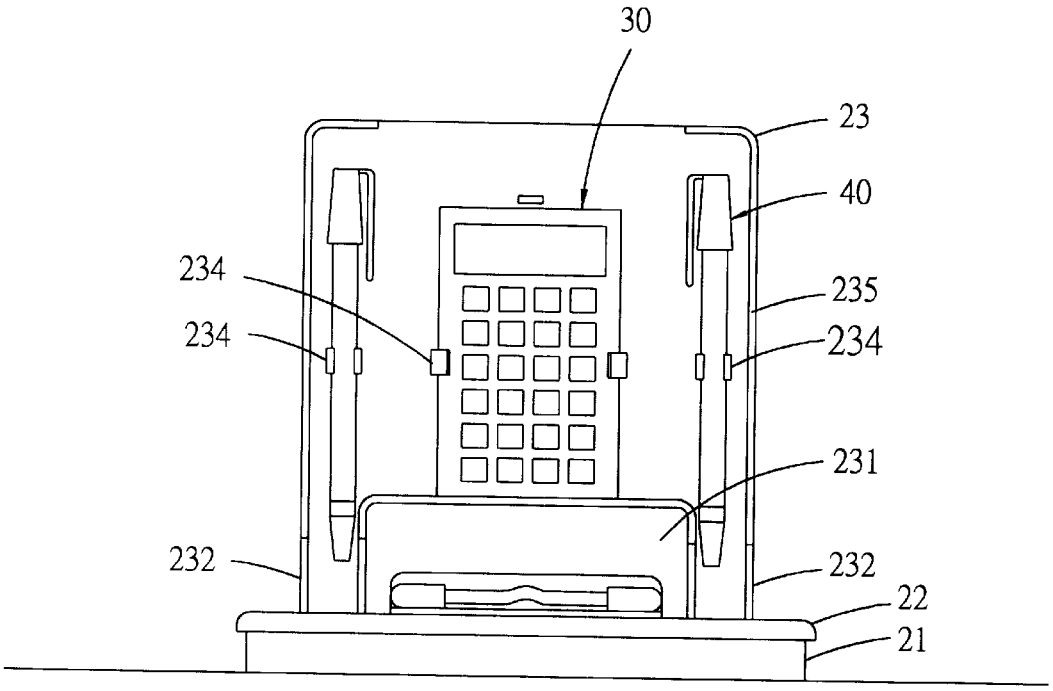
FIG. 5 is a front view of an upper plate with some stationery hooked on its lower surface in the present invention.

The upper board 23 is also made of plastic, having a rectangular shape, smaller than the cap board 22, covering on the cap board 22, having a recess opening 231 in a front end portion to let the clip 224 expose when the upper board is closed on the cap board 22. The upper board 23 further has two projecting portions 232 at two sides of the recess opening 231, and each projecting portions 232 has a shaft 233 extending from a lower front end to both sides to fit in the outer two pivot grooves 217 of the two pivot ears 216, enabling the upper board 23 lifted up from the board 22 with the shafts 233 as pivots. Next, referring to FIG. 5, the upper board 23 further has plural pre-arranged hooks 234 on a lower surface to hold a calculator 300, pens 3, and sidewalls 235 on two sides of the bottom to raise the upper board a little on the board 22 when it is closed on the board 22.

Figure 6:
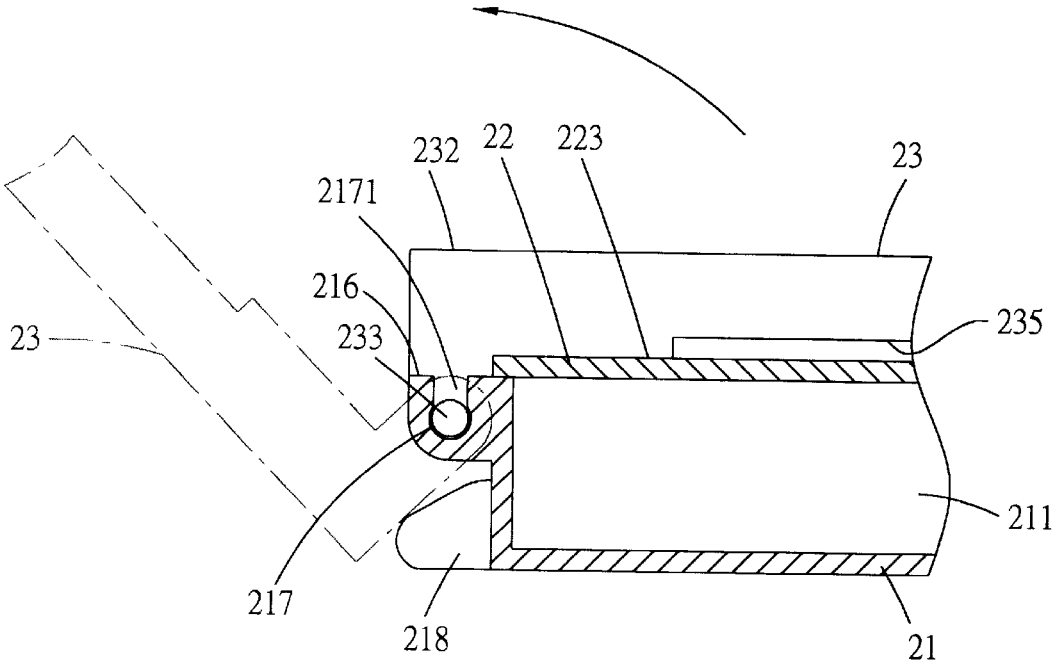
FIG. 6 is a partial side cross-sectional view of the collapsible clipboard in the present invention, showing how the upper board lifted up to the front side.

In assembling, referring to FIGS. 3, 4 and 6, firstly, the two small shafts 222 of the board 22 are placed on the openings 2171 of the two inner pivot ears 216 and then press the board 22 down, then the two shafts 222 slide into the pivot grooves 217 to secure the cap board 22 with the bottom case 21. Then the upper board 23 is also secured with the bottom case 21 in the same way, with the two shafts 233 fitting in the two outer pivot grooves 217 through the openings 2171.

Figure 7:
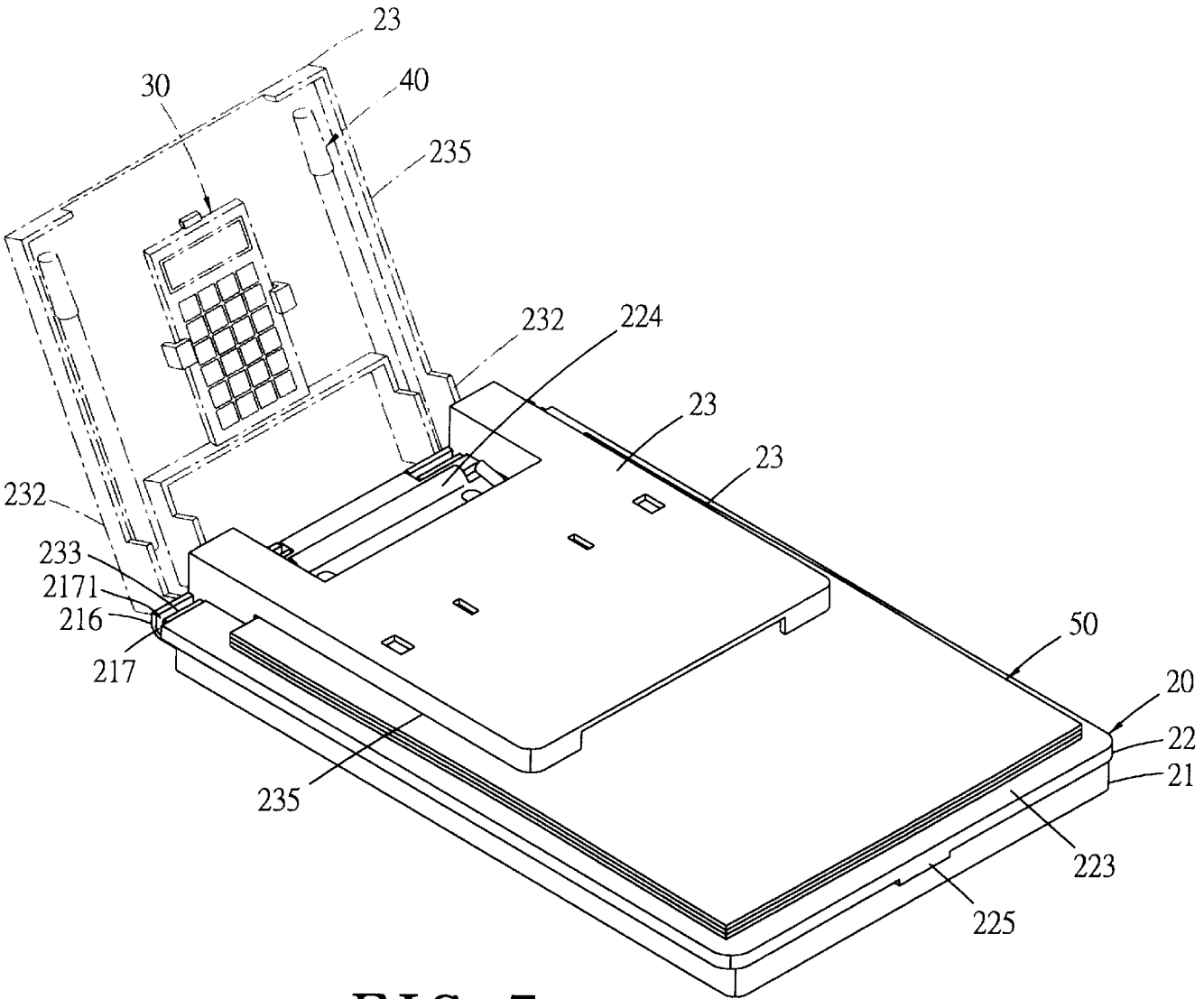
FIG. 7 is a perspective view of the collapsible clipboard in the present invention, showing paper placed on a cap board and the upper board being lifted up.

In using, referring to FIGS. 6 and 7, the hollow interior 211 of the bottom case 21 stores papers 50, paper to be written is to be placed on the surface 223 of the board 22 and be pinched with the clip 24 after the upper board is first lifted up until the two side projections 232 touch the stop blocks 218 and stabilized, as shown in the dotted lines in FIG. 6. Then the upper board 23 and the cap board 22 are separated with a large angle, easy for a user to take a calculator 30 or a pen 40 from the lower surface of the upper board 23. When a paper 50 placed on the cap board 22 is written fully and to be stored in the bottom case 21, the paper 50 is taken off, with the cap board 22 lifted up, and with the engage projection 225 disengaging from the small engage projection 219 to let the hollow interior of the 211 of the bottom case 21 expose. Then the paper 50 may be placed in the hollow interior 211, guided by the tapered ribs 212, and the cap board 22 is closed on the bottom case 21 again. When the cap board 20 is finished in use, the upper board 23 is pulled down on the cap board 22, and the clipboard 20 can be hung up with the hang hole 213 of the bottom case 21. If there is still paper 50 pinched on the board 222, the two side walls 235 may rest on the paper 50 to close smoothly the upper board 23 on the cap board 22.

Besides, the stop blocks 218 may be formed on the front end of the two projections 232, so when the upper board 23 is lifted up from the cap board 22, the stop blocks 218 is also lifted up to be stopped at the front end of the bottom case 21, having the same function.

Figure 8:
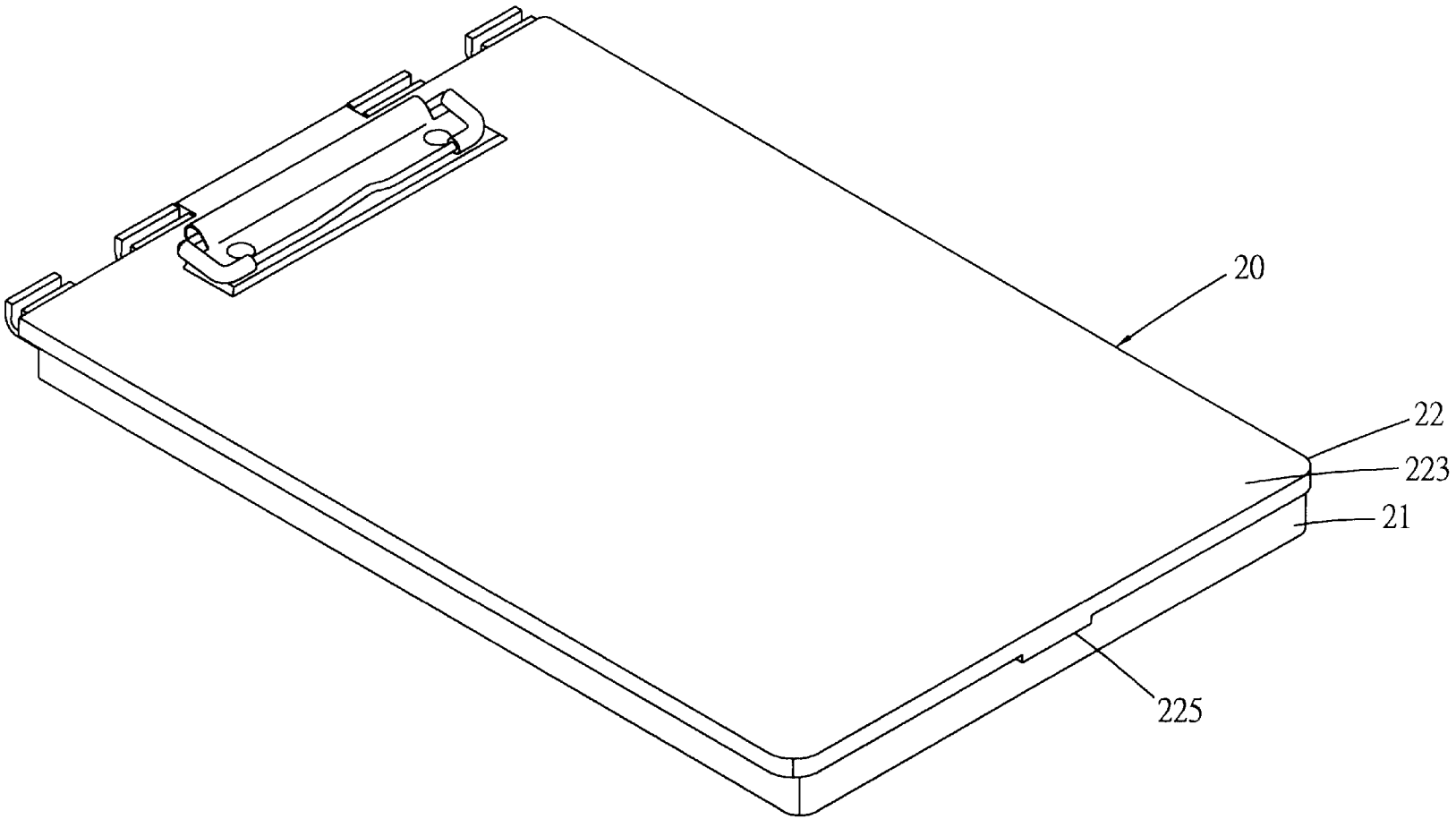
FIG. 8 is a perspective view of a collapsible clipboard without the upper board not combined in the present invention.

As shown in FIG. 8, the upper board 23 may be not needed, if a calculator is not needed.

The invention has the following advantages, as understood from the aforesaid description.

1. The clipboard is made of plastic, except the elastic clip 224 fixed on the cap board 22, with the other components combined together without need of a second process. In addition, the bottom case 21, the cap board 22 and the upper board 23 can be combined together easily and quickly by means of the pivot grooves 271 in open condition, lessening work time and labor.
2. The inner hollow interior of the bottom case 21 has a height shorter than the conventional clipboard so as to be able to contain the same volume of papers as the conventional one, and the cap board 22 has a shorter height also than the conventional one, convenient to carry along. In packaging the bottom case 21, the cap board 22 and the upper board 23 may be collapsed to permit the upper board 23 possible to be placed in the inner hollow interior 211 of the bottom case 21 to save the whole size of a carton, reducing cost for transportation.

While the preferred embodiment of the invention has been described above, it will be recognized and understood that various modifications may be made therein and the appended claims are intended to cover all such modifications that may fall within the spirit and scope of the invention.

I claim:

1. A collapsible clipboard comprising:

A bottom case formed integral of plastic, having an interior hollow space for storing paper and a plurality of pivot ears formed spaced apart on an upper outer surface of a front sidewall, each pivot ear having a pivot groove and an upper opening narrower than the inner diameter of the pivot groove:

A cap board formed integral of plastic, having the same size and shape as said bottom case to close pivotally on said bottom case, having a pivot on a middle section of a front side, said pivot having a smaller diameter shaft than that of said pivot extending respectively from two sides of said pivot, said two smaller diameter shafts fitting in two inner ones of said pivot ears of said bottom case to enable said cap board lifted up with said shafts as pivots, and an elastic clip fixed on an upper middle section of said cap board for pinching paper:

An upper board formed integral of plastic, having a smaller size than said cap board to pivotally close on said cap board, having two shafts extending sidewise from two sides of a bottom of a front end and fitting in two outer ones of said pivot ears of said bottom case to enable said upper board pivotally lifted up from said cap board, a plurality of hooks fixed on a lower surface for hooking an outer circumferential edge of a calculator, and plural stop blocks formed on a front end to stop said upper board when said upper board is lifted up, forming an angle between said upper board and said cap board.

2. The collapsible clipboard as claimed in claim 1, wherein said bottom case has two lengthwise sidewalls formed with a plurality of tapered ribs spaced apart on their inner side surfaces.

3. The collapsible clipboard as claimed in claim 1, wherein said bottom case has a hang hole bored in a front middle section of a bottom for said clipboard to be hung up for storing away.

4. The collapsible clipboard as claimed in claim 1, wherein said upper board has a recess opening formed in a front end portion and abutting said two side projections, just located on said elastic clip of said cap board to permit said clip to expose, avoiding said upper board from colliding with said elastic clip, and having a shaft formed respectively to extend from the two sides of said two projecting portions to fit in said pivot grooves of said pivot ears of bottom case to enable said upper board to be lifted up with said shafts as pivots.

5. The collapsible clipboard as claimed in claim 1, wherein said upper board has a short sidewall formed respectively on two lengthwise sides of a lower surface.

6. The collapsible clipboard as claimed in claim 1, wherein said stopper blocks are formed on a front side surface of said bottom base under said pivot ears.

7. The collapsible clipboard claimed in claim 1, wherein said stopper blocks are formed on the front end of said two side projections of said upper board.

* * * * *